US007069628B2

(12) United States Patent
Droux et al.

(10) Patent No.: US 7,069,628 B2
(45) Date of Patent: Jul. 4, 2006

(54) METHOD, INSTALLATION FOR THE PRODUCTION OF MATS AND USE ASSOCIATED THEREWITH

(75) Inventors: Michel Droux, La Ravoire (FR); François Roederer, Chambery (FR); Manuela Astro, San Giovanni (IT); Filippo Mauri, Rome (IT)

(73) Assignee: Saint-Gobain Vetrotex France S.A., Chambery (FR)

( * ) Notice: Subject to any disclaimer, the term of this patent is extended or adjusted under 35 U.S.C. 154(b) by 110 days.

(21) Appl. No.: 10/474,342

(22) PCT Filed: Mar. 20, 2002

(86) PCT No.: PCT/FR02/00966

§ 371 (c)(1),
(2), (4) Date: Mar. 4, 2004

(87) PCT Pub. No.: WO02/084005

PCT Pub. Date: Oct. 24, 2002

(65) Prior Publication Data

US 2004/0154147 A1 Aug. 12, 2004

(30) Foreign Application Priority Data

Apr. 11, 2001 (FR) ..... 01 04966

(51) Int. Cl.
*D04H 3/05* (2006.01)

(52) U.S. Cl. ..... 28/101

(58) Field of Classification Search ..... 28/100, 28/101, 102; 19/160, 163
See application file for complete search history.

(56) References Cited

U.S. PATENT DOCUMENTS

| | | | | |
|---|---|---|---|---|
| 3,883,333 | A * | 5/1975 | Ackley | 28/107 |
| 4,158,557 | A | 6/1979 | Drummond | |
| 4,345,927 | A | 8/1982 | Picone | |
| 4,404,717 | A * | 9/1983 | Neubauer et al. | 28/107 |
| 4,555,492 | A * | 11/1985 | Ekdahl et al. | 501/38 |
| 4,558,015 | A | 12/1985 | Ekdahl et al. | |
| 4,692,375 | A * | 9/1987 | Neubauer et al. | 442/406 |
| 5,051,122 | A * | 9/1991 | Reese et al. | 65/450 |
| 5,448,802 | A * | 9/1995 | Pirnes et al. | 28/101 |
| 5,645,677 | A | 7/1997 | Cahuzac et al. | |

FOREIGN PATENT DOCUMENTS

| | | |
|---|---|---|
| DE | 199 42 121 | 3/2001 |
| EP | 0 428 063 | 5/1991 |

* cited by examiner

*Primary Examiner*—Danny Worrell
(74) *Attorney, Agent, or Firm*—Oblon, Spivak, McClelland, Maier & Neustadt, P.C.

(57) ABSTRACT

A plant for the manufacture of mats formed of continuous yarns originating from bobbins and thrown onto a conveyor belt. The plant includes at least one bobbin supported on a spindle, a guide for guiding a fiber bundle leaving the bobbin, a mechanism for pulling the fiber bundle, and a mechanism for throwing the yarns that make up the fiber bundle onto the conveyor belt. The guide for guiding, the mechanism for pulling, and the mechanism for throwing the fiber bundle are fixed, located in the continuation of one another and at one and a same level. The throwing mechanism includes a swinging arm for throwing the yarn transversely to the conveyor belt and the guide is arranged such that the fiber bundle is paid out from the bobbin from the outside.

27 Claims, 3 Drawing Sheets

METHOD, INSTALLATION FOR THE PRODUCTION OF MATS AND USE ASSOCIATED THEREWITH

CROSS-REFERENCE TO RELATED DOCUMENTS

The present document is the U.S. counterpart of WO 02/084,005, the contents of which are hereby incorporated herein by reference, and claims priority to French application 01/04966 filed Apr. 11, 2001, the contents of which are thereby incorporated herein by reference.

The present invention relates to the manufacture of mats formed of continuous yarns and, in particular, glass yarns, and to the manufacture of composites produced using such mats.

Products known by the name of "mats" are essentially products used as reinforcements in composite materials and generally comprise glass yarns themselves formed of filaments. A distinction is generally made between two types of mat: chopped yarn mats and continuous yarn mats.

Mats made of continuous glass yarns are products which are well known and are generally used for producing composite products by molding, particularly by compression molding or by injection molding. They are generally obtained by distributing continuous yarns on a conveyor in a continuous and superposed distribution of layers, each layer being obtained from a die by drawing glass threads in the form of continuous filaments, then by collecting the filaments together into yarns and throwing these yarns onto the conveyor (with a swinging or back-and-forth movement so that the yarns are swept across all or part of the width of the conveyor) which moves transversely to the direction of the thrown yarns, cohesion of the yarns within the mat generally being afforded by a binder deposited on the yarns and then treated in an oven. Documents WO 98/10131 et al., commented upon hereinbelow, illustrate this type of manufacture.

Somewhat varied properties are looked for in continuous glass yarn mats depending on the envisioned application; for example, when these mats are intended for the production of composites by pultrusion or are intended for electrical applications or for insulation, it is desirable to use flat mats consisting of yarns which are strongly bound together and have only small gaps between the yarns. By contrast, when these mats are intended for the production of injection-molded composites, it is desirable to use mats which are open enough and, in particular, which have or maintain enough bulk for a given weight of yarn.

The present invention relates more specifically to a plant for the manufacture of such products.

It can be used to manufacture both "flat" mats and "open" (or bulk) mats.

Various techniques and plants are known in this field.

Thus, patent U.S. Pat. No. 4,368,232 discloses a mat formed of two layers of continuous yarns, one originating from a die and the other from a bobbin or roving. It is recalled here that a roving is a winding of a fiber bundle formed of base yarns gathered together to a greater or lesser extent around the spindle of the bobbin. According to one characteristic of that patent, the yarns originating from the roving are broken open by a fixed nozzle supplied with compressed air which allows the yarn to drop under gravity onto a conveyor belt situated beneath.

Also known is patent U.S. Pat. No. 3,265,482 which describes a machine for throwing continuous glass yarn onto a belt. More specifically, the machine allows the yarn to be deposited across the entire width of the belt which passes beneath the machine. The yarn comes directly from the dies, which means that large quantities of yarn can thus be deposited on the belt. Mats such as those defined above are formed here.

Improvements to this type of manufacture have been proposed, for example in document WO 98/10131, filed in the name of the applicant company, which describes the manufacture of an anisotropic mat, that is to say one in which the vast majority of the yarns have a preferred orientation. This improves certain mechanical properties. A "back-and-forth" movement of the yarn transversely to the conveyor belt allows the yarn to be distributed in the preferred orientation.

Patent U.S. Pat. No. 4,158,557 describes a machine for the manufacture of mats from yarn originating from at least one die or from rovings. The device for throwing the yarn onto the belt "sweeps" the conveyor belt transversely; the special feature of this plant is a variation in the speed at which the yarn is thrown onto the conveyor belt.

Patents U.S. Pat. No. 4,345,927 and U.S. Pat. No. 5,051,122 disclose this same type of machine with improvements to the throwing member itself.

More specifically, the solution envisioned in patent U.S. Pat. No. 4,345,927 consists in throwing the yarn onto a plate, known as a rebound plate given its function. The yarn preferably originates from a die and is driven by a collection of wheels then accelerated by a device of the nozzle type. Here again, the nozzle and the plate are given a transverse movement to spread the yarn across the belt. This movement does not give a homogeneous distribution of the yarns on the belt, the edges receiving less yarn than the central part of the belt.

In document U.S. Pat. No. 4,948,408, the yarns come directly from a die, then pass around a distributor roller which gives the yarn a swinging movement transverse to the conveyor belt. A plate known as a deflection plate is provided downstream of the yarn distributor roller, above the conveyor belt. The yarn leaving the roller strikes the plate, the surface of which is preferably striated so as to increase the breadth of the bundle of base yarns (of which the yarn is formed) which drops onto the conveyor belt.

The present invention, as has been stated, typically relates to the field of mats formed of continuous yarns originating from rovings (or bobbins).

In the case of fiber bundles which originate not from dies but from rovings, these fiber bundles have been dried before winding, and the base yarns of which they are made are partially stuck together in the roving. By paying out the rovings, the base yarns are therefore stuck together to some extent, which means that there is a problem here as the aim is actually to throw the base yarns onto the conveyor belt as homogeneously as possible.

As the present invention also has the special feature of being able to deal with yarns originating from rovings (or bobbins), it is possible to obtain small production runs of mats, for example mats made from expensive and/or special-purpose yarns. It is possible, for example, to associate the plant with one or more rovings, to thus manufacture the mat in a limited quantity, with the advantageous characteristics which will be mentioned hereinafter, then to switch to another production run based on other rovings, that is to say from other base yarns.

As has already been mentioned briefly, the major difficulty encountered with this type of production relates to the separating of the base yarns of which the yarn (or fiber bundle) wound around the roving consists.

Concepts which use a rebound nozzle partially solve this problem. However, the roving is usually paid out from the inside, which is theoretically the simplest method. In point of fact, this method introduces twist into the fiber bundle as it leaves the roving. This detracts from the quality of the mat produced, even if a nozzle is provided for breaking the fiber bundle open more successfully.

The subject of the present invention is another concept based on paying the roving out from the outside. This thus avoids any twisting of the fiber bundle, which means that the base yarns are not held together as firmly as they leave the roving. Furthermore, an appropriate subsequent treatment leads to complete separation of the base yarns thus thrown onto the conveyor belt.

Moreover, dealing with fiber bundles originating from rovings generally leads to the process having to be stopped as soon as one roving has been paid out. Human intervention is then needed to replace the "empty" roving, which takes time and therefore lowers the production output.

There has therefore been a search for a way in which to automate the change in roving, and the present invention proposes a solution to that problem, within the aforementioned context, namely while at the same time having optimum separation of the base yarns.

Thus, a subject of the invention is a plant for the manufacture of mats formed of continuous yarns originating from bobbins and thrown onto a conveyor belt, comprising:

at least one bobbin supported on a spindle;

a means of guiding a fiber bundle leaving a bobbin;

at least one means for pulling the fiber bundle;

a means of throwing the yarns that make up the fiber bundle onto said conveyor belt.

According to the invention, said means for guiding, for pulling and for throwing the fiber bundle are fixed, located in the continuation of one another and at one and the same level, the throwing means comprises a swinging arm for throwing the yarn transversely to the conveyor belt and the means of guiding the fiber bundle is arranged in such a way that the fiber bundle is paid out from the bobbin from the outside.

Furthermore, the plant according to the invention may comprise a means of controlling and varying the speed of the spindle said bobbin, according in particular to the outside diameter of the bobbin.

Furthermore, the installation comprises a means of synchronizing the speeds of the fiber bundle leaving the bobbin and the fiber bundle in the pulling means slaved to the bobbin.

Additionally, the plant may comprise a means of detecting the presence of the fiber bundle, this means being arranged downstream of the or each bobbin.

More specifically, the means of pulling the fiber bundle comprises three pulleys (or wheels), the axes of which are horizontal and mutually parallel, and a motor for driving said wheels.

Without departing from the scope of the invention, the plant further comprises a means of immobilizing the fiber bundle when the latter has a diameter that exceeds a given threshold.

A cutting tool, associated with the immobilizing means and arranged downstream thereof, is for cutting the fiber bundle when the latter is immobilized by the immobilizing means.

In addition, the plant may comprise a means of detecting the movement of the fiber bundle, this means being arranged downstream of the immobilizing means and associated with the yarn-throwing means.

According to one embodiment of the invention, the swinging arm of the means of throwing the yarn onto the conveyor belt carries a nozzle equipped with means for supplying compressed air and for supplying water.

The compressed air encourages the fiber bundle to be broken open more uniformly and more reliably. The water increases the angle at which the broken-open fiber bundle falls.

More specifically, said nozzle may comprise a venturi arranged between the means for supplying compressed air and for supplying water.

According to an advantageous feature of the invention, the swinging arm also bears a rebound plate placed downstream of said nozzle.

According to a preferred embodiment of the invention, the plant comprises two bobbins, each associated with a means of pulling the fiber bundle, and said bobbins are operated in turn.

More specifically, associated with each means of pulling the fiber bundle is a presence-detection means, an immobilizing means and a cutting tool.

Continuous production is thus obtained without stoppages which are detrimental to productivity.

The invention is also aimed at a method for the manufacture of mats which are formed of continuous yarns originating from at least one bobbin and thrown onto a conveyor belt, comprising the following steps in turn:

paying out from the bobbin which consists of a fiber bundle;

guiding the fiber bundle outside of the bobbin;

pulling the fiber bundle;

breaking open the fiber bundle into base yarns;

throwing the yarns transversely to the conveyor belt.

According to the invention, the five steps are carried out more or less in one and the same plane and at one and the same level, the paying-out from the bobbin is done from the outside, and the yarns are thrown by an arm the axis of swinging of which is fixed.

Advantageously, the speed at which the fiber bundle is pulled and the speed at which it is paid out are synchronized.

Uniform throwing of the yarn is thus obtained, and this yields a mat of high quality.

An additional feature of the method consists in detecting the end of paying-out of each bobbin (or roving).

Advantageously, anomalies in the diameter of the fiber bundle being unwound are also detected and the fiber bundle is cut as soon as an anomaly is detected.

The anomalies detected in this way may be loops or knots in the fiber bundle.

The method according to the invention also consists in running two groups of components in turn so as to pay out from a great many bobbins originating from each of these two groups alternately.

Finally, the invention covers the uses of the plant and/or of the method as defined by claims 20 to 22.

Other features, details, and advantages of the invention will become more apparent from reading the description which follows, given by way of entirely non-limiting illustration with reference to the appended drawings, in which.

Figure 1:
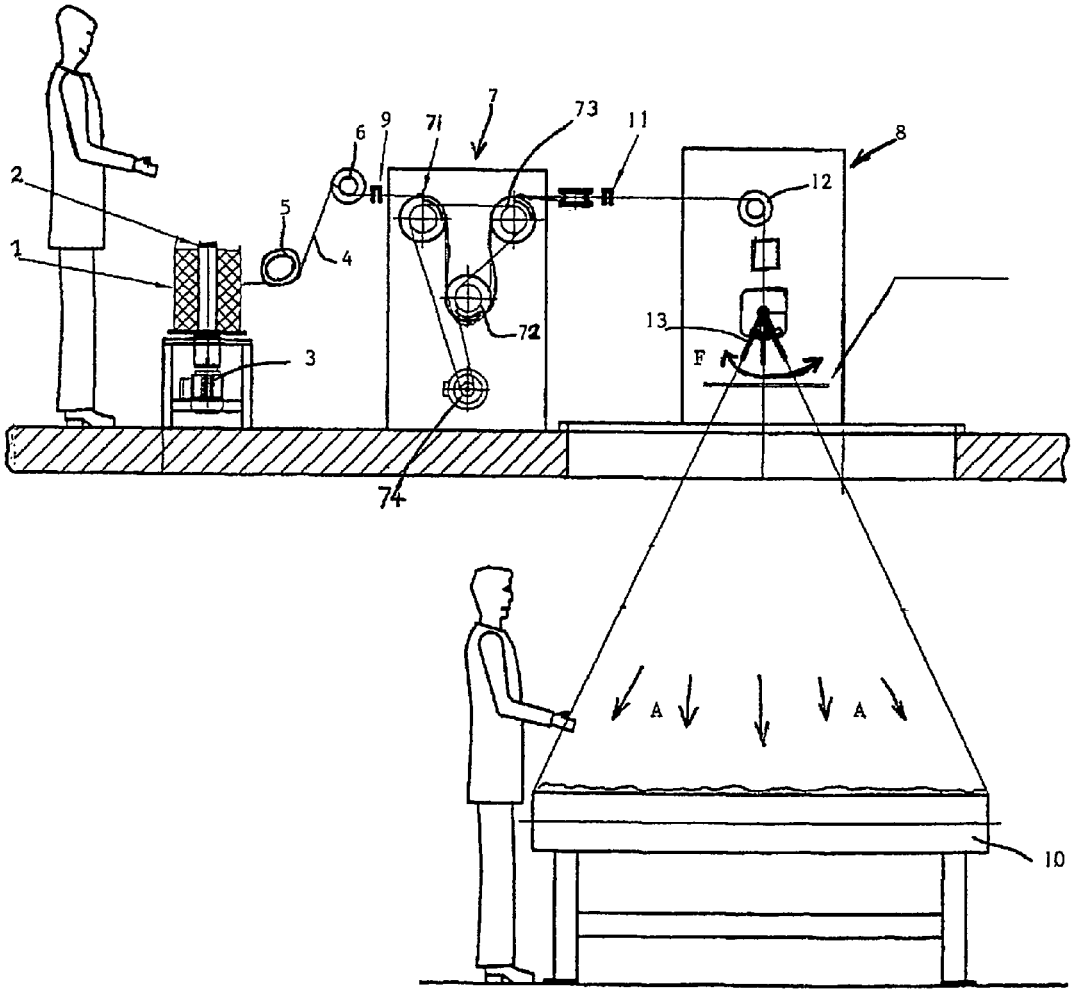
FIG. 1 is an overall diagram of one embodiment of the invention.

FIG. 1 reveals the main constituent parts of a plant according to the invention.

A bobbin 1, also known as a roving in the remainder of this text, is connected to a vertical spindle 2 which is driven by a motor 3.

The spindle 2 of the bobbin may have any orientation, without departing from the scope of the invention.

The bobbin 1 is formed of a winding (shown symbolically by cross-hatching in FIG. 1), for example consisting of a fiber bundle 4 made of glass yarns.

The material of which the (base) yarns are made is a glass that can be drawn into fibers, such as glass E or alkali-resistant glass known as AR glass, which contains at least 5 mol % of $ZrO_2$. In particular, the use of AR glass yields a continuous yarn mat that provides an effective reinforcement for cementing matrices.

The fiber bundle 4 is paid out by unwinding, that is to say from the outside of the winding, as illustrated schematically in FIG. 1.

Any device known per se may be provided for guiding the fiber bundle 4 from the bobbin 1 to a means 7 of pulling the fiber bundle 4. For example, two pulleys 5, 6 may be used for this guidance.

The pulling means 7 may comprise three pulleys 71, 72, 73 or wheels around which the fiber bundle 4 is partially and successively wound.

The wheels 71, 72, 73 each have a horizontal or roughly horizontal axis. The axes of the wheels need to be mutually parallel. They are preferably horizontal.

The means 7, also known to those skilled in the art as the delivery means, further comprises a motor 74 for driving the wheels 71, 72, 73. A drive belt (not referenced) can be used to transmit the movement. The motor 74 drives the wheels 71, 72, 73 at constant speed and is synchronized (by any means known per se) with the motor 3 that drives the bobbin 1, which motor itself delivers a variable speed of rotation of the bobbin.

By way of illustration, the (constant) linear speed of the fiber bundle 4 at the device 7 is of the order of 8 m/s and, depending on the outside diameter of the bobbin 1, the angular velocity of the fiber bundle leaving the bobbin 1 varies from 500 rpm to 1500 rpm. The means 7 therefore guarantees a constant production output.

Downstream of the means 7, relative to the direction of travel of the fiber bundle 4 in the plant, there is a means 8 of throwing the base yarns that form each fiber bundle 4 onto a conveyor belt 10 which passes beneath.

In addition, a means 9 of detecting the presence of the fiber bundle 4 may be provided, this being arranged between the bobbin 1 and the pulling means 7. This element 9 makes it possible to detect the end of the paying-out of a bobbin 1. This event triggers various controls so as to begin to pay out from another bobbin, as will be explained in greater detail hereinbelow.

Furthermore, a means 11 of detecting an anomaly in the diameter of the fiber bundle is placed between the pulling means 7 and the throwing means 8. The means 11 may be an eyelet of a given diameter, through which a fiber bundle of at most the same diameter can therefore pass. Thus, any bunching or other build-ups (knots, loops, etc.) around the fiber bundle will not pass through the means 11 and will remain immobilized. These anomalies may result from faulty paying-out of the fiber bundle, from poor winding, or alternatively from defective manufacture of the fiber bundle itself.

A cutting tool (not depicted) may possibly be provided in conjunction with the detector 11.

Figure 3:
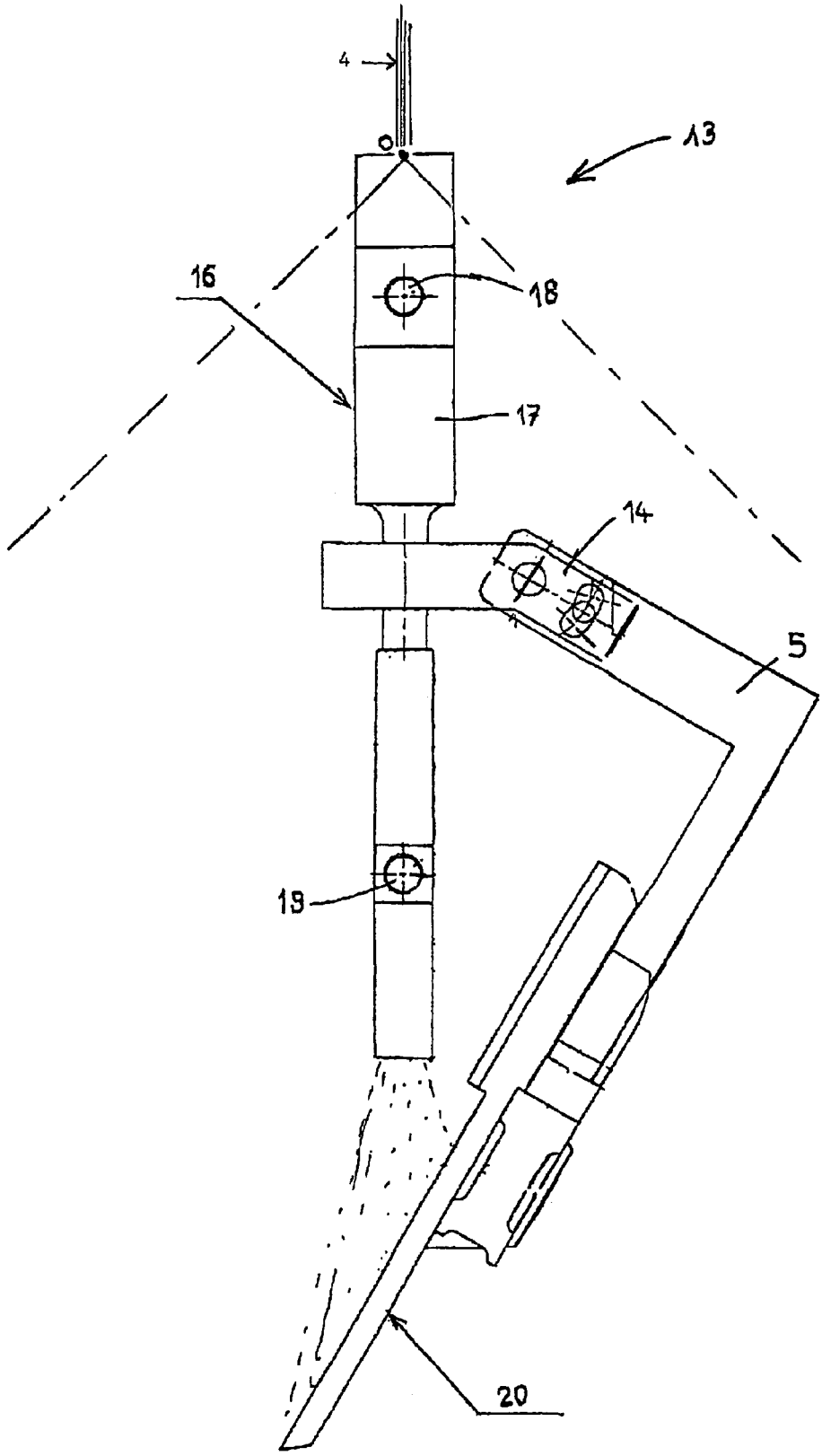
FIG. 3 is a simplified side view of a nozzle according to one embodiment of the invention.

The throwing means 8 has the following particular features illustrated in greater detail by FIG. 3.

It comprises an inlet wheel 12, known as the deflection wheel, which changes the orientation of the fiber bundle 4 from the horizontal direction to a vertical direction.

Vertically aligned with this wheel 12 there is a swinging member 13 given a swinging movement about a horizontal axis O, as indicated by the arrow F in FIG. 1.

The swinging member as depicted in greater detail in FIG. 3 comprises an arm (not depicted) to which is fixed a nozzle 16 with which a rebound plate 20 may be associated. The arm 13 is fixed by any appropriate means to the spindle of a motor 15 (visible in FIG. 2) which swings it back and forth. A holding element 14, such as a flange, is fixed to the hub of a motor 15 (visible in FIG. 2) which drives its rotation. Fixed to the flange 14 is a nozzle 16 for breaking the fiber bundle 4 open. One or more connecting elements are provided for this.

As a preference, the nozzle 16 comprises a tubular body equipped with a venturi 17 for breaking the fiber bundle 4 open into its base yarns.

The fiber bundle 4, by passing longitudinally through the nozzle 16, is broken open so that, as it leaves the nozzle, it is its base yarns which are thrown, possibly after having bounced off the plate 20, onto the conveyor belt 10 situated beneath.

Supplies of air 18 and of water 19 open into the nozzle: The air supply 18 is situated toward the entry of the fiber bundle 4 into the nozzle 16 while the supply of water 19 is placed toward the exit of the fiber bundle 4 from the nozzle 16.

The air supply 18, associated with the venturi arranged just downstream, allows the fiber bundle to be broken open.

The water supply 19 adds weight to the fiber bundle or rather to the base yarns which are thrown onto the belt 10 as indicated by the arrows A in FIG. 1.

Without departing from the scope of the invention, a dilute aqueous dispersion or solution containing an active substance may be via the supply 19. This solution may then give the mat special properties such as the formation of a thin surface film, or better compatibility with the substance that is to be reinforced.

By way of illustration, upstream of the nozzle 16, the air flow rate is of the order of 12 $m^3$/h. The water flow rate is of the order of 30 liters per hour.

Furthermore, in order to ensure a constant inlet speed for the fiber bundle 4 entering the nozzle 16, the various connecting elements will be adjusted in such a way that the fiber bundle 4 enters the nozzle 16 along the axis of oscillation O.

Finally, if a particularly homogeneous fiber bundle is to be treated, the swinging member 13 may be equipped with a rebound plate 20 connected to the nozzle 16 and situated near the exit from the nozzle. The partially broken open fiber bundle thus strikes the plate 20 and is broken open completely so that the base filaments are thrown in a properly dispersed and satisfactorily homogeneous way onto the belt 10 which passes beneath.

Advantageously, a coupling 14 makes it possible to adjust the angle between the rebound plate 20 and the nozzle 16 so as to direct the bundle of base yarns as it leaves the nozzle.

Another advantageous feature of the invention relates to the continuity of the paying-out of the bobbins.

Figure 2:
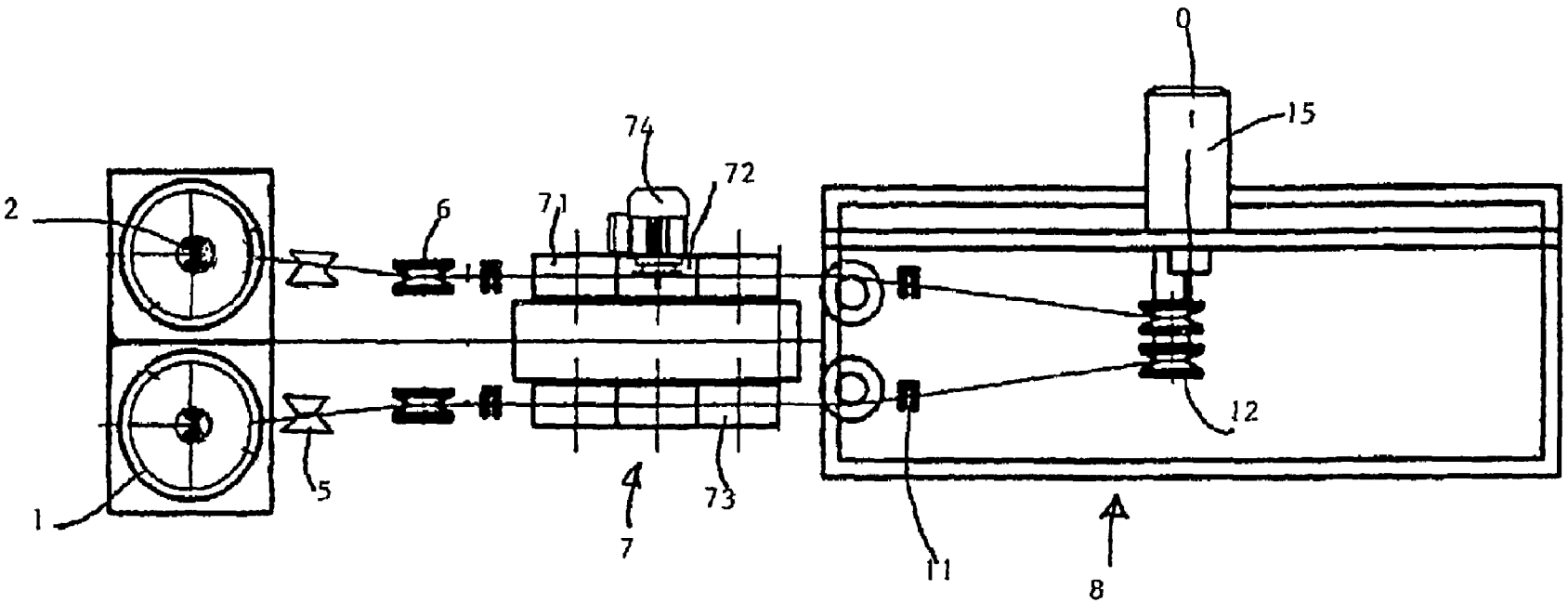
FIG. 2 is a view from above of part of the plant according to the invention.

As can be seen in FIG. 2, the plant according to the invention may comprise two groups in parallel.

More precisely, each group here consists of: one bobbin 1, the pulleys 5, 6, the pulling means 7, the detector 11, the deflection wheel 12 and the nozzle 16.

When one bobbin 1 is in the paying-out phase, all the elements associated and aligned with this bobbin are in operation and they convey the fiber bundle 4 as far as the associated nozzle 16.

When the detector 9 detects the absence of a fiber bundle 4 in its vicinity, this triggers the shutting-down of the aforementioned various elements which were conveying the fiber bundle as far as the nozzle 16; at the same time, this detection initiates the starting-up of the other group of elements (mounted in series) in parallel with the first group which pay out from a second bobbin 1 and convey another fiber bundle 4 as far as another nozzle 16.

This alternation represents a significant gain in production output because it allows the yarn to be delivered to the belt 10 almost constantly.

While one bobbin is being paid out, an operator can attend to an inactive nearby bobbin, and change it, so as to prepare, in parallel time, for the supply of the second group of elements.

In concrete terms, rovings could be paid out one after the other with human intervention between each paying-out operation. What happens is that a roving of 2400 tex, weighing about 24 kg, contains 10,000 meters of fiber bundle paid out, for example, at a rate of 8 m/s. This paying-out takes approximately 20 minutes. On an industrial scale, it is unthinkable for production to be halted every 20 minutes to change a roving, with a down time of a few minutes between each paying-out operation, with human intervention.

It has therefore proved necessary to have various devices arranged in series, to form two parallel groups of devices operating alternately.

At the nozzles 16, two nozzles are secured together and swing back and forth at the same time, about the same axis O, one delivering and the other not.

One and the same motor 74 operates one paying-out device and then the other alternately; and a reverser (not depicted) changes the supply air and liquid from one nozzle 16 to the other at the time of the changeover.

What is claimed is:

1. A plant for manufacture of mats formed of continuous yarns originating in a form of a fiber bundle from at least one bobbin supported on a spindle, the yarns being thrown onto a conveyor belt, that plant comprising:

means for outputting the fiber bundle from the bobbin;

guide means for guiding; and means for throwing the yarns onto the conveyor belt, the throwing means comprising a swinging arm for throwing the yarns transversely to the conveyor belt and the guide means arranged such that the bobbin is paid out from an outside.

2. The plant as claimed in claim 1, wherein the outputting means comprises pulling means and said means for guiding, pulling and throwing the fiber bundle are fixed, located in a continuation of one another and at one and a same level.

3. The plant as claimed in claim 2, further comprising:

means for synchronizing speeds of the fiber bundle leaving the bobbin and of the fiber bundle in the pulling means.

4. The plant as claimed in claim 3, wherein the pulling means is slaved to the bobbin.

5. The plant as claimed in claim 2, wherein the means for pulling the fiber bundle comprises three pulleys, axes of which are horizontal and mutually parallel, and a motor for driving the three pulleys.

6. The manufacturing plant as claimed in claim 1, further comprising:

means for controlling and varying a speed of the spindle of the bobbin.

7. The plant as claimed in claim 1, further comprising:

means for detecting a presence of the fiber bundle, the detecting means being arranged downstream of the bobbin.

8. The plant as claimed in claim 1, further comprising:

means for immobilizing the fiber bundle when the fiber bundle has a diameter that exceeds a given threshold.

9. The plant as claimed in claim 8, further comprising:

a cutting tool, associated with the immobilizing means and arranged downstream of the immobilizing means, to cut the fiber bundle when immobilized by the immobilizing means.

10. The plant as claimed in claim 8, further comprising:

means for detecting movement of the fiber bundle, the detecting means being arranged downstream of the immobilizing means and associated with the yarn-throwing means.

11. The plant as claimed in claim 1, wherein the swinging arm of the means for throwing the yarn onto the conveyor belt carries a nozzle equipped with means for supplying compressed air and for supplying water.

12. The plant as claimed in claim 11, wherein the nozzle comprises a venturi arranged between the means for supplying compressed air and for supplying water.

13. The plant as claimed in claim 11, wherein the swinging arm also bears a rebound plate placed downstream of the nozzle.

14. The plant as claimed in claim 1, comprising two bobbins actuated in succession, each bobbin comprising an outputting means comprising a pulling means.

15. The plant as claimed in claim 14, wherein associated with each pulling means is a presence-detection means, means for immobilizing the fiber bundle, and a tool for cutting the fiber bundle.

16. A method for manufacture of mats formed of continuous yarns originating in a form of fiber bundles from at least one bobbin supported on a spindle, comprising:

paying-out the bobbin from an outside;

then, guiding the fiber bundle outside of the bobbin;

then, breaking-open of the fiber bundle into base yarns; and then, throwing the yarns onto a conveyor belt by an arm, an axis of swinging of which is fixed.

17. The method as claimed in claim 16, wherein the fiber bundle is pulled between its guiding and its breaking-open, and wherein the paying-out, the guiding, the pulling, the breaking-open, and the throwing are performed substantially in one and a same plane and at a same level.

18. The method as claimed in claim 17, wherein a speed at which the fiber bundle is pulled and a speed at which the fiber bundle is paid out are synchronized.

19. The method as claimed in claim 17, wherein the pulling is slaved to the bobbin.

20. The method as claimed in claim 16, wherein an end of paying-out of each bobbin is detected.

21. The method as claimed in claim 16, further comprising detecting anomalies in a diameter of the fiber bundle being unwound.

22. The method as claimed in claim 21, further comprising detecting the fiber bundle as soon as an anomaly is detected.

23. The method as claimed in claim 20, wherein two groups of components are operated alternately to pay out from plural bobbins in turn.

24. The method as claimed in claim 16, wherein the mat is formed of continuous yarns of the same nature.

25. The method as claimed in claim 24, wherein the mat is formed of continuous glass yarns.

26. The method as claimed in claim 16, wherein the mat is formed of continuous yarns of different natures that are commingled.

27. The method as claimed in claim 16, wherein the continuous yarns are made of alkali-resistant glass.

* * * * *